United States Patent [19]

Clark

[11] 4,199,636

[45] Apr. 22, 1980

[54] INSULATION

[76] Inventor: William H. Clark, 4284 E. State St., Sharon, Pa. 16146

[21] Appl. No.: 15,139

[22] Filed: Feb. 26, 1979

[51] Int. Cl.[2] ..... B32B 3/06; B32B 3/12

[52] U.S. Cl. ..... 428/114; 428/119; 428/188; 428/166; 428/178; 428/464; 428/920

[58] Field of Search ..... 428/114, 464, 178, 166, 428/188, 920, 118, 119

[56] References Cited

U.S. PATENT DOCUMENTS

| | | | |
|---|---|---|---|
| 1,939,306 | 12/1933 | Leslie | 428/177 |
| 2,045,733 | 6/1936 | Spafford | 428/177 |
| 2,221,309 | 11/1940 | Gazelle | 428/464 |
| 2,238,022 | 4/1941 | Johnson | 428/188 |

*Primary Examiner*—George F. Lesmes
*Assistant Examiner*—E. Rollins Buffalow
*Attorney, Agent, or Firm*—Webster B. Harpman

[57] ABSTRACT

An insulation material comprised of multiple layers of treated newspaper spaced in relation to one another for use as side wall or ceiling insulation bats and wall board in older homes.

7 Claims, 6 Drawing Figures

INSULATION

BACKGROUND OF THE INVENTION (1) Field of the Invention

This invention relates to insulation material of the type formed of paper or the like for use as insulation in building structures.

(2) Description of the Prior Art

Prior structures of this type have utilized various types of paper construction configurations. See for example U.S. Pat. Nos. 1,939,306 and 2,045,733.

In U.S. Pat. No. 1,939,306 an insulation material is disclosed wherein sheets of paper having a plurality of scattered projections thereon are placed one upon another forming a mat of insulation.

In the present invention multiple layers of treated newspaper are spaced and secured together by a number of treated elongated tubes formed of rolled newspaper.

In U.S. Pat. No. 2,045,733 an insulation structure is disclosed utilizing a series or pile of corrugated material adhesively joined to one another in an overlapping manner with additional sheets of paper secured thereover.

In the present invention a number of separate sheets of newspaper are treated and combined being secured to each other in spaced relation by a number of treated rolled tubes of newspaper secured thereto.

SUMMARY OF THE INVENTION

Insulation formed of multiple layers of newspaper spaced with respect to one another by a number of randomly placed elongated tubes of rolled newspaper secured thereto by being treated with a solution of fire preventing and insect resistant preservative such as is known in the art for wall and ceiling insulation in homes or the like.

DESCRIPTION OF THE PREFERRED EMBODIMENT

Figure 1:
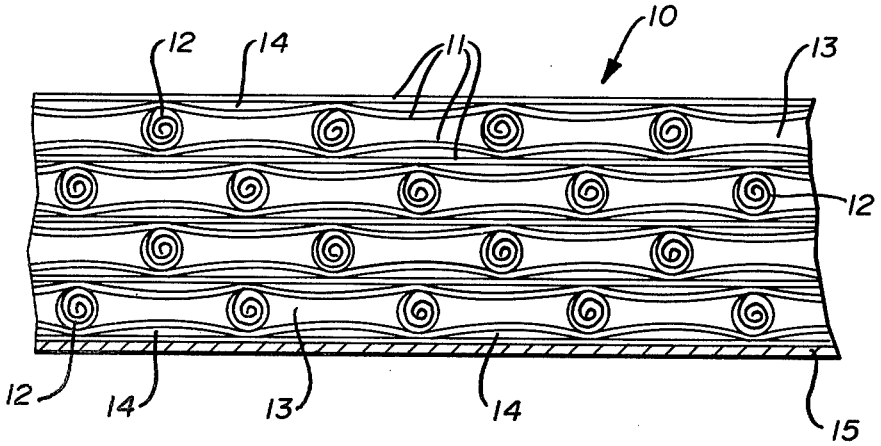
FIG. 1 is a cross section of the insulation.

In FIG. 1 of the drawings a section of insulation 10 is shown comprising a number of rectangular body members 11 spaced in relation to each other by a plurality of elongated tubular members 12. Each of said body members 11 is made from one or more sheets of newspaper treated with a solution that acts as a fire retardant and preservative and known to those skilled in the art as water glass. Each of said tubular members 12 is formed from sheets of newspaper treated with said solution and rolled upon themselves.

The multiple layers of body members 11 alternately spaced with rows of tubular members 12 form a plurality of air spaces 13 and 14 which serve as an insulation barrier against transmission of heat and cold through the insulation 10.

A layer of foil backing 15 is applied to one of the outermost layers of the body members 11.

Figure 2:
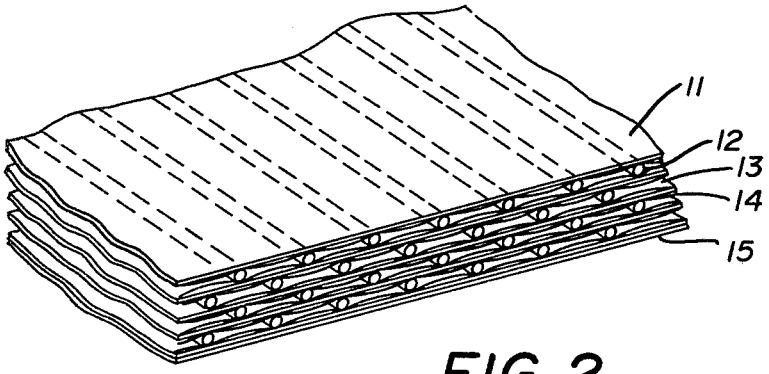
FIG. 2 is a perspective view of the insulation.

By referring now to FIG. 2 of the drawings, it will be seen that said insulation as hereinbefore described forms a bat of material with a length greater than its width. The elongated tubular members 12 run transversely across said insulation and allows for flexibility of the insulation which is required during handling and shipping of the same.

The water glass solution also acts as an adhesive binder for the multiple elements of said body members 11 and said tubular members 12 and is composed of a solution of sodium silicate or potassium silicate and water, such as 40% $Na_2Si_3O_7$ and 60% $H_2O$.

Figure 3:
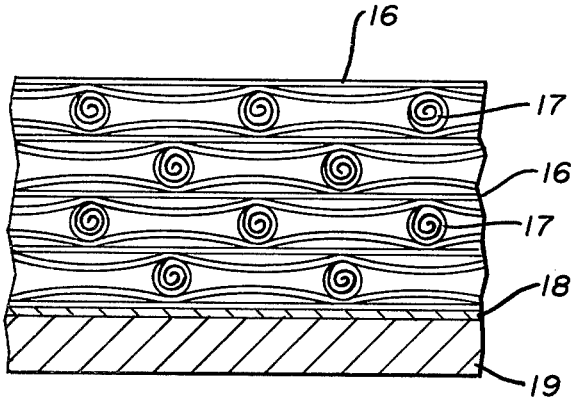
FIG. 3 is a cross section of an alternate form of the insulation.
Figure 4:
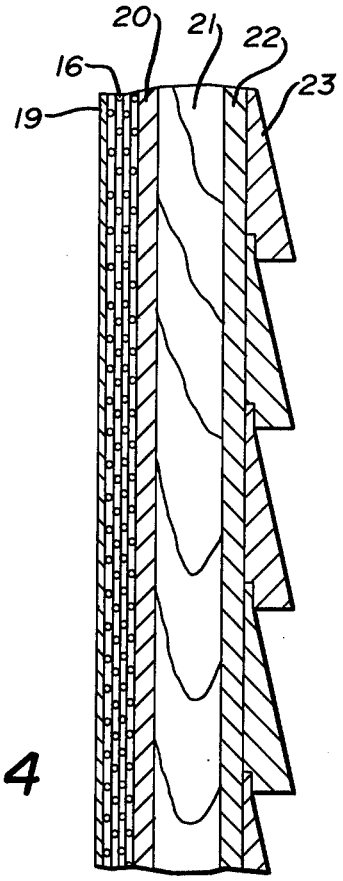
FIG. 4 is a cross section of a wall showing the insulation applied thereto.

In FIGS. 3 and 4 of the drawings, an alternate form of the insulation is shown wherein rectangular body members 16 are spaced in relation to one another by a number of elongated tubular body members 27. Said body members 16 are made from one or more sheets of newspaper, said tubular body members 17 are formed by rolling sheets of newspaper in upon themselves. Both said body members 16 and tubular members 17 are treated with a solution of fire retardant and preverving material such water glass.

A foil backing 18 is applied to one of the outermost layers of the body members 16. A rigid material 19 such as a pressed wood, hardboard, or particle board is secured to the foil backing 18 by a suitable adhesive thereby forming a rigid insulated wall panel.

In FIG. 4 of the drawings, the wall panel is shown secured to the interior side of an existing exterior wall 19, said wall 19 comprises an interior wall surface 20, a stud 21, sheathing 22, and exterior siding 23.

Figure 5:
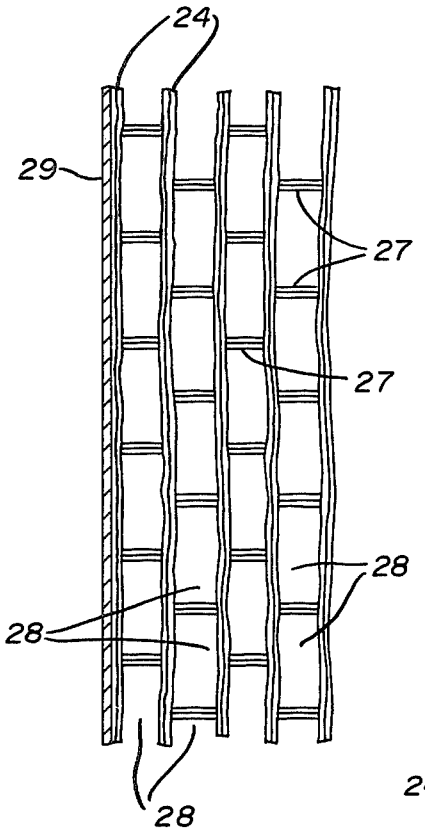
FIG. 5 is a perspective view of an alternate form of the insulation.
Figure 6:
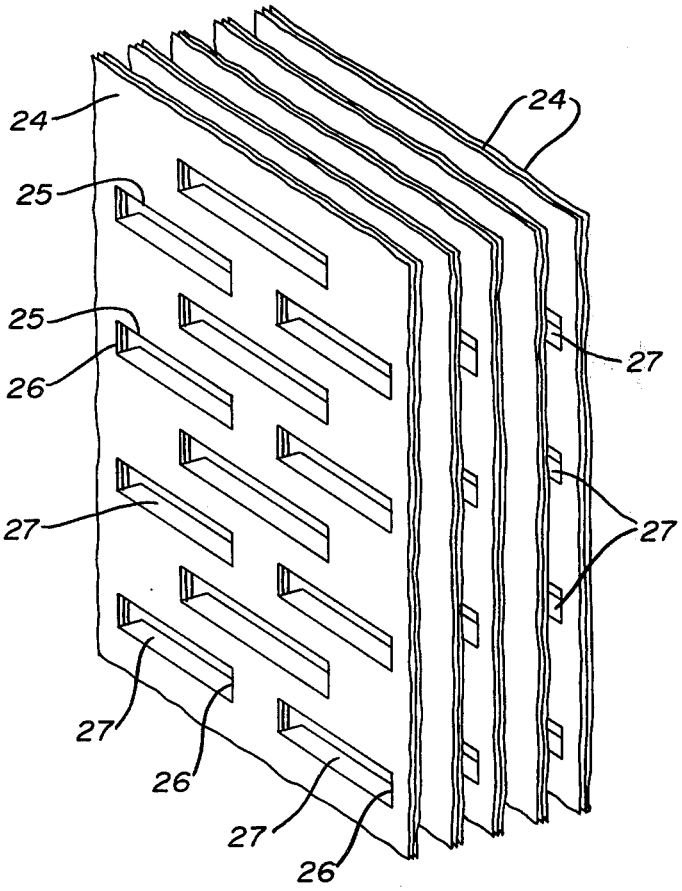
FIG. 6 is a perspective view of the insulation of FIG. 5.

In FIGS. 5 & 6 of the drawings, an alternate form of insulation is shown consisting of a number of rectangular body members 24 made from one or more sheets of water glass treated newspaper, said body members 24 having a plurality of elongated cuts 25 with secondary cuts 26 at right angles thereto on oppositely disposed ends of said cuts 25.

The material defined by said cuts 25 and 26 is bent at a right angle to the plane of said body member 24 forming a flap 27. The plurality of flaps 27 are randomly positioned about the body member 24 so as to engage adjacent body members 24 which are secured to each other by the adhesive binding properties of a water glass solution so as to form a number of air spaces 28 therebetween. A foil backing 29 is secured to one of the outermost body members 24 providing a radiant barrier for the insulation.

Thus the insulation material hereinbefore described utilizes multiple layers of treated newspaper, each layer comprised of a number of single sheets loosely secured together having numerous insulating air spaces therebetween, the layers of newspaper so formed being spaced with relation to one another by tubular members formed from a loose spiral configuration of treated newspaper. The insulation material has a radiant reflective foil backing applied to one of the exterior surfaces of said layers of newspaper thereby forming an easily and inexpensively manufactured insulation that utilizes waste newspaper.

In the alternate form of the insulation disclosed, multiple layers of treated newspaper made from one or more single single sheets of newspaper loosely secured together have a plurality of randomly positioned flaps formed therein so as to provide spacing elements between the layers thereby increasing the insulation factor of the insulation and improving its flexibility which is important because the increased flexibility is essential when installing the insulation in existing walls.

The insulating material and its alternates as hereinbefore described achieve a unique solution to two of the major problems facing low and fixed income groups in uninsulated older structures; the first being the need for a low cost insulating material that can be applied to the existing structures and secondly the disposal of waste newspapers in our society.

Although but three embodiments of the present invention have been illustrated and described, it will be apparent to those skilled in the art that various changes and modifications may be made therein without departing from the spirit of the invention and having thus described my invention what I claim is:

1. Insulation material consisting of a plurality of layers of newspaper, each of said layers formed of several sheets of newspaper loosely attached to one another so as to form many small air spaces therebetween, tubular members spacing each of said plurality of layers so as to form several large air spaces between said layers, said tubular members formed of rolled newspaper, a fire resistant, preservative and binding material securing said insulation material together.

2. The insulation material of claim 1 wherein said tubular members are formed of loosely rolled newspaper having air spaces between the convolutions of the rolls.

3. The insulation material of claim 1 wherein said tubular members are loosely rolled newspaper having air spaces between the convolutions of the rolls and are arranged transversely in relation to said layers providing longitudinal flexibility.

4. The insulation material of claim 1 wherein a layer of reflective foil is secured to one of said layers of newspaper on an exterior surface of the insulation.

5. The insulation material of claim 1 wherein a sheet of rigid material is secured to one of said layers of newspaper on an exterior surface of the insulation.

6. The insulation material of claim 5 wherein a layer of reflective foil is present.

7. The insulation material of claim 3 wherein a layer of reflective foil is secured to one of said layers of newspaper on an exterior surface of the insulation.

* * * * *